US006276819B1

(12) United States Patent
Gordner

(10) Patent No.: US 6,276,819 B1
(45) Date of Patent: Aug. 21, 2001

(54) ADJUSTABLE SUPPORT DEVICE FOR A TROUBLE LIGHT

(76) Inventor: Roger Gordner, R.D. #1, Box 144, Milville, PA (US) 17846

( * ) Notice: Subject to any disclaimer, the term of this patent is extended or adjusted under 35 U.S.C. 154(b) by 0 days.

(21) Appl. No.: 09/649,880

(22) Filed: Aug. 28, 2000

(51) Int. Cl.[7] ..... F21V 21/00
(52) U.S. Cl. ..... 362/398; 362/396; 248/206.5
(58) Field of Search ..... 362/398, 396, 362/388, 393, 413, 404, 405, 406, 430, 427, 371, 147; 248/206.5, 291.1, 299.1, 286.1, 683

(56) References Cited

U.S. PATENT DOCUMENTS

| | | | | |
|---|---|---|---|---|
| 1,932,143 | * | 10/1933 | Piercy | 248/206.5 |
| 2,669,650 | * | 2/1954 | Smith | 248/206.5 |
| 3,696,239 | * | 10/1972 | Duddy | 362/275 |
| 3,917,940 | * | 11/1975 | Duddy | 362/398 |
| 4,506,317 | * | 3/1985 | Duddy | 362/396 |
| 4,965,708 | * | 10/1990 | Louis | 362/398 |
| 5,213,412 | * | 5/1993 | Ciallella | 362/398 |

* cited by examiner

*Primary Examiner*—Sandra O'Shea
*Assistant Examiner*—Bao Truong
(74) *Attorney, Agent, or Firm*—Goldstein Law Office P

(57) ABSTRACT

An adjustable support device for a trouble light including a base member comprised of a cylindrical lower section and a rounded upper section. The cylindrical lower section has a lower end. The lower end has a notch extending upwardly thereof. The notch has a magnetic surface disposed thereon whereby the notch can be secured to a ferrous surface. The rounded upper section has a central channel extending downwardly thereof. The rounded upper section has a cross-bar extending laterally therethrough with a center section exposed within the central channel. A sleeve member is pivotally coupled with respect to the base member. The sleeve member includes a lower rod and an upper expandable cylindrical sleeve. The lower rod has a lower end having an aperture therethrough. The aperture receives the center section of the cross-bar of the base member therethrough. The lower rod has an upper end secured to the upper expandable cylindrical sleeve. The expandable upper cylindrical sleeve has a relaxed diameter less than the diameter of the tubular handle of the trouble light. The expandable upper cylindrical sleeve has an open upper end for receiving the tubular handle of the trouble light therein.

5 Claims, 2 Drawing Sheets

ADJUSTABLE SUPPORT DEVICE FOR A TROUBLE LIGHT

BACKGROUND OF THE INVENTION

The present invention relates to an adjustable support device for a trouble light and more particularly pertains to allowing a trouble light to be secured to a metal surface whereby the light can be adjusted to shine on a work area.

The use of support devices for lights is known in the prior art. More specifically, support devices for lights heretofore devised and utilized for the purpose of supporting lights are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,985,817 to Yale discloses a support device for an emergency light comprised of a magnet attached to a spring clip with two lateral surfaces forming a circular recess. U.S. Pat. No. 5,154,509 to Wulfman discloses a light system comprised of a set of magnets attached to a support channel capable of receiving a triangular shaped track light. U.S. Pat. No. 4,506,317 to Duddy discloses a magnetic support for a battery operated flashlight.

While these devices fulfill their respective, particular objective and requirements, the aforementioned patents do not describe an adjustable support device for a trouble light for allowing a trouble light to be secured to a metal surface whereby the light can be adjusted to shine on a work area.

In this respect, the adjustable support device for a trouble light according to the present invention substantially departs from the conventional concepts and designs of the prior art, and in doing so provides an apparatus primarily developed for the purpose of allowing a trouble light to be secured to a metal surface whereby the light can be adjusted to shine on a work area.

Therefore, it can be appreciated that there exists a continuing need for a new and improved adjustable support device for a trouble light which can be used for allowing a trouble light to be secured to a metal surface whereby the light can be adjusted to shine on a work area. In this regard, the present invention substantially fulfills this need.

SUMMARY OF THE INVENTION

In the view of the foregoing disadvantages inherent in the known types of support devices for lights now present in the prior art, the present invention provides an improved adjustable support device for a trouble light. As such, the general purpose of the present invention, which will be described subsequently in greater detail, is to provide a new and improved adjustable support device for a trouble light which has all the advantages of the prior art and none of the disadvantages.

To attain this, the present invention essentially comprises a base member comprised of a cylindrical lower section and a rounded upper section. The cylindrical lower section has a lower end. The lower end has a V-shaped notch extending upwardly thereof. The V-shaped notch has a magnetic surface disposed thereon whereby the V-shaped notch can be secured to a ninety degree ferrous surface. The rounded upper section has a central channel extending downwardly thereof. The rounded upper section has a cross-bar extending laterally therethrough with a center section exposed within the central channel. A sleeve member is pivotally coupled with respect to the base member. The sleeve member includes a lower rod and an upper expandable cylindrical sleeve. The lower rod has a lower end having an aperture therethrough. The aperture receives the center section of the cross-bar of the base member therethrough. The lower rod has an upper end secured to the upper expandable cylindrical sleeve. The expandable upper cylindrical sleeve has a vertical expansion slot extending a length thereof. The expandable upper cylindrical sleeve has a relaxed diameter less than the diameter of the tubular handle of the trouble light. The expandable upper cylindrical sleeve has an open upper end for receiving the tubular handle of the trouble light therein. The expandable upper cylindrical sleeve has a plurality of laterally disposed annular recesses formed therein in a spaced relationship. The annular recesses receive cable ties for preventing the expansion of the vertical slot.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable support device for a trouble light which has all the advantages of the prior art support devices for lights and none of the disadvantages.

It is another object of the present invention to provide a new and improved adjustable support device for a trouble light which may be easily and efficiently manufactured and marketed.

It is a further object of the present invention to provide a new and improved adjustable support device for a trouble light which is of durable and reliable construction.

An even further object of the present invention is to provide a new and improved adjustable support device for a trouble light which is susceptible of a low cost of manufacture with regard to both materials and labor, and which accordingly is then susceptible of low prices of sale to the consuming public, thereby making such an adjustable support device for a trouble light economically available to the buying public.

Even still another object of the present invention is to provide a new and improved adjustable support device for a trouble light for allowing a trouble light to be secured to a metal surface whereby the light can be adjusted to shine on a work area.

Lastly, it is an object of the present invention to provide a new and improved adjustable support device for a trouble light including a base member comprised of a cylindrical lower section and a rounded upper section. The cylindrical lower section has a lower end. The lower end has a notch extending upwardly thereof. The notch has a magnetic surface disposed thereon whereby the notch can be secured to a ferrous surface. The rounded upper section has a central channel extending downwardly thereof. The rounded upper section has a cross-bar extending laterally therethrough with a center section exposed within the central channel. A sleeve member is pivotally coupled with respect to the base member. The sleeve member includes a lower rod and an upper expandable cylindrical sleeve. The lower rod has a lower end having an aperture therethrough. The aperture receives the center section of the cross-bar of the base member therethrough. The lower rod has an upper erd secured to the upper expandable cylindrical sleeve. The expandable upper cylindrical sleeve has a relaxed diameter less than the diameter of the tubular handle of the trouble light. The expandable upper cylindrical sleeve has an open upper end for receiving the tubular handle of the trouble light therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
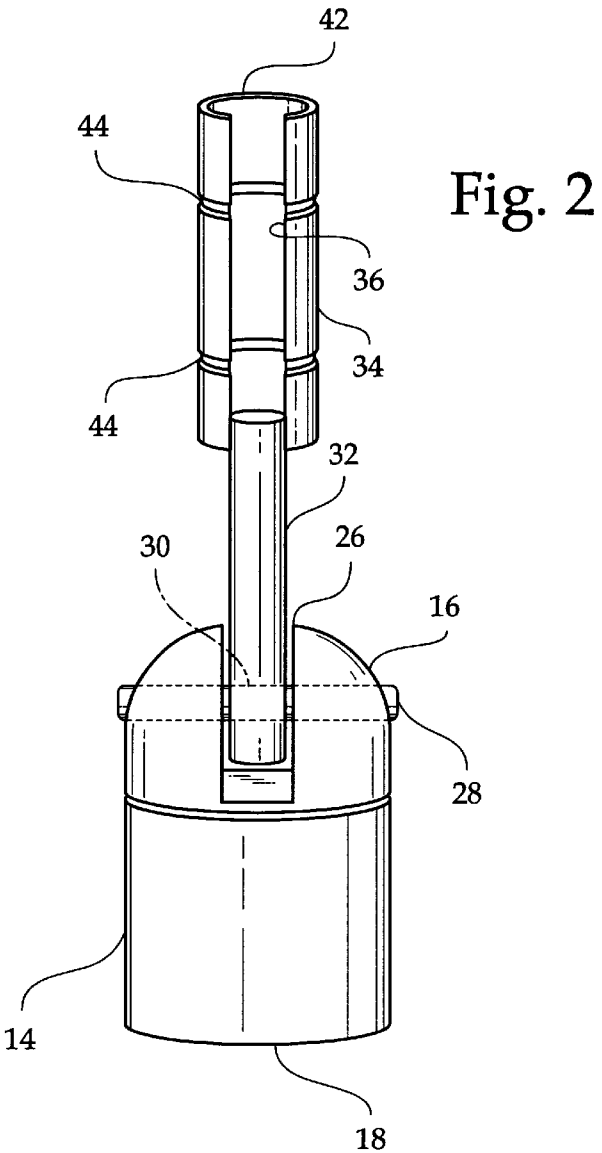
FIG. 2 is a front view of the present invention.
Figure 1:
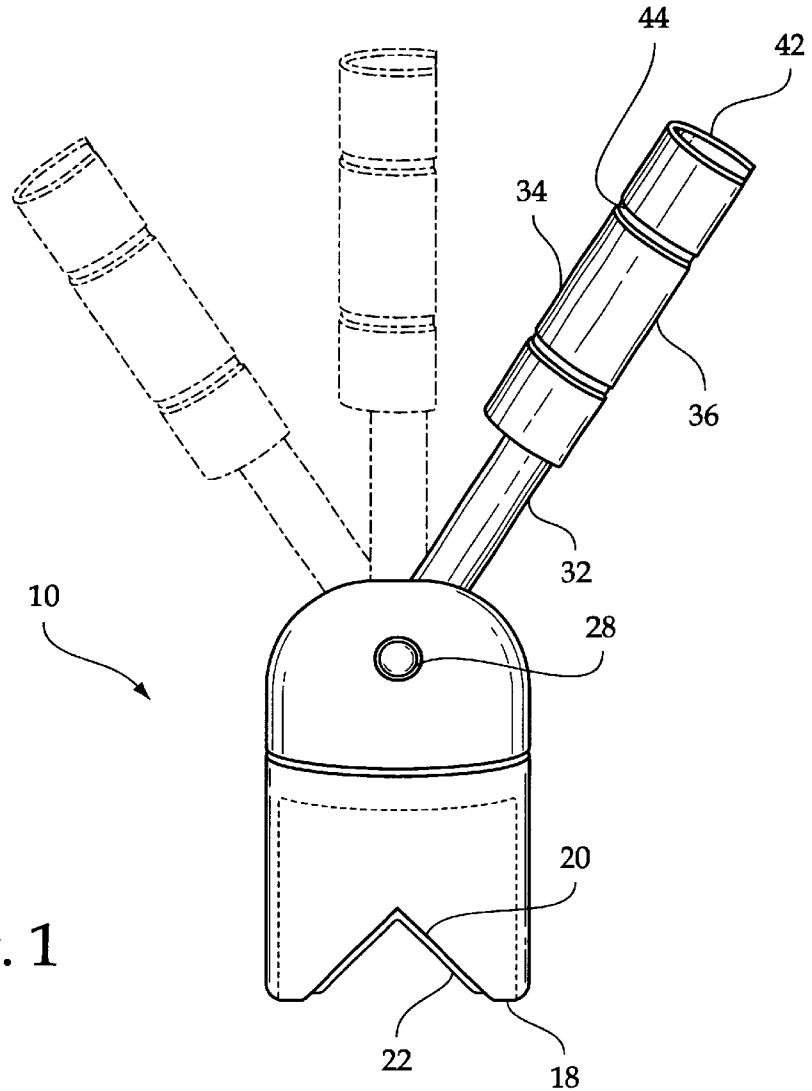
FIG. 1 is a perspective view of the preferred embodiment of the adjustable support device for a trouble light constructed in accordance with the principles of the present invention.
Figure 3:
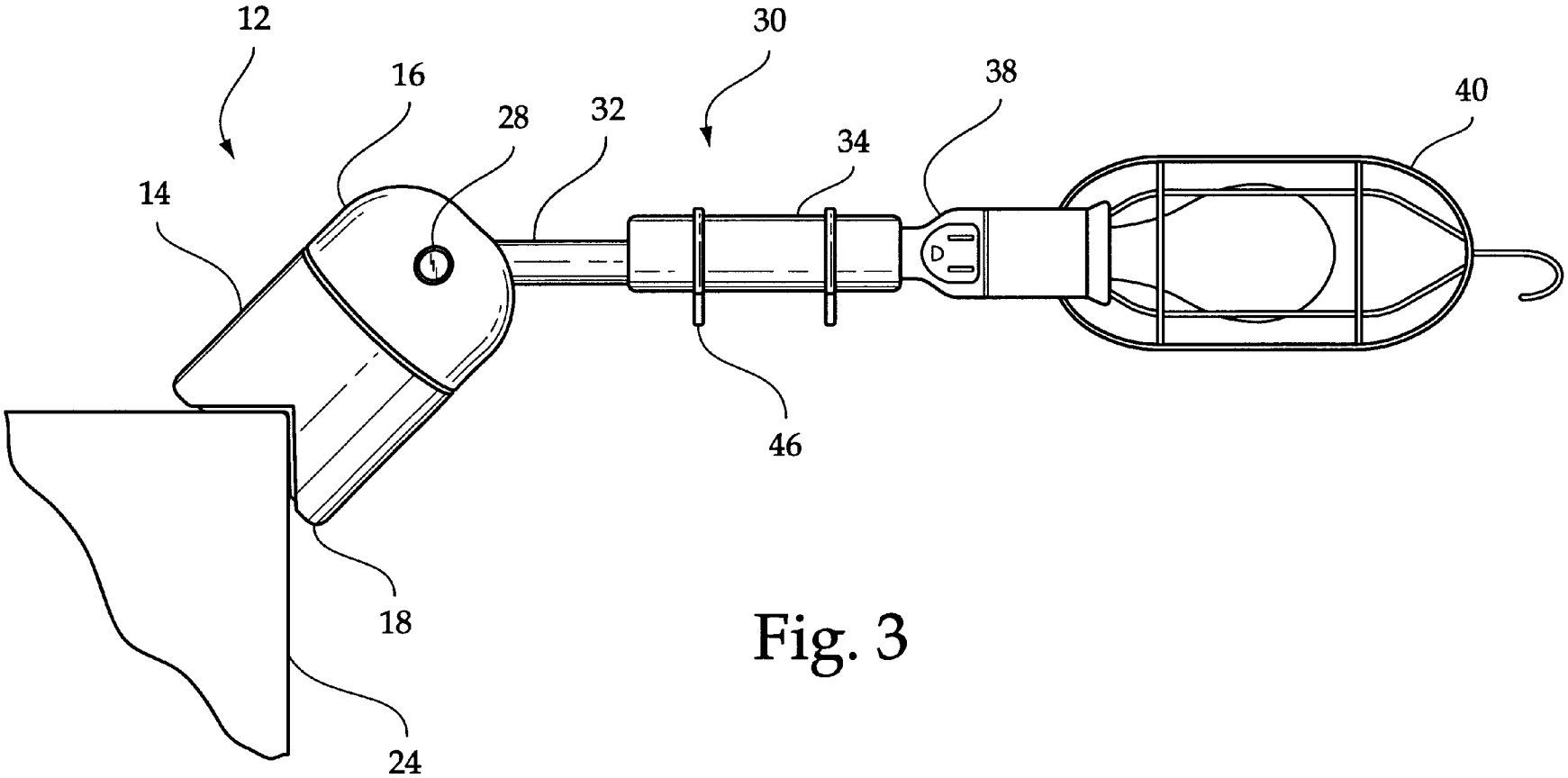
FIG. 3 is a side view of the present invention illustrated in use.

With reference now to the drawings, and in particular, to FIGS. 1 through 3 thereof, the preferred embodiment of the new and improved adjustable support device for a trouble light embodying the principles and concepts of the present invention and generally designated by the reference number 10 will be described.

Specifically, it will be noted in the various figures that the device relates to an adjustable support device for a trouble light for allowing a trouble light to be secured to a metal surface whereby the light can be adjusted to shine on a work area. In its broadest context, the device consists of a base member and a sleeve member. Such components are individually configured and correlated with respect to each other so as to attain the desired objective.

The base member 12 is comprised of a cylindrical lower section 14 and a rounded upper section 16. The cylindrical lower section 14 has a lower end 18. The lower end 18 has a V-shaped notch 20 extending upwardly thereof. The V-shaped notch 20 has a magnetic surface 22 disposed thereon whereby the V-shaped notch 20 can be secured to a ninety degree ferrous surface 24. Note FIG. 3. The V-shaped notch 20 with the magnetic surface 22 allow the device 10 to be secured to an edge of a table or it can also be secured to a pipe, as long as these items have metallic properties. The rounded upper section 16 has a central channel 26 extending downwardly thereof. The rounded upper section 16 has a cross-bar 28 extending laterally therethrough with a center section 30 exposed within the central channel 26.

The sleeve member 30 is pivotally coupled with respect to the base member 12. The sleeve member 30 includes a lower rod 32 and an upper expandable cylindrical sleeve 34. The lower rod 32 has a lower end having an aperture therethrough. The aperture receives the center section 30 of the cross-bar 28 of the base member 12 therethrough. The lower rod 32 has an upper end secured to the upper expandable cylindrical sleeve 34. The expandable upper cylindrical sleeve 34 has a vertical expansion slot 36 extending a length thereof. The expandable upper cylindrical sleeve 36 has a relaxed diameter less than the diameter of the tubular handle 38 of the trouble light 40. The expandable upper cylindrical sleeve 34 has an open upper end 42 for receiving the is tubular handle 38 of the trouble light 40 therein. The expandable upper cylindrical sleeve 34 has a plurality of laterally disposed annular recesses 44 formed therein in a spaced relationship. The annular recesses 44 receive cable ties 46 for preventing the expansion of the vertical expansion slot 36.

In use, the tubular handle 38 of the trouble light 40 is pushed through the open upper end 42 of the cylindrical sleeve 34 whereby the sleeve 34 will expand to conform to the tubular handle 38. The cable ties 46 are then tightened to prevent the further expansion of the expansion slot 36 to secure the trouble light 40 to the device 10. The user then positions the base member 12 at a selected location by aligning the V-shaped notch 20 with a metallic surface 24 that is close enough to the work area so the trouble light 40 can illuminate the work area for the user to properly see.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable support device for a trouble light for allowing a trouble light to be secured to a metal surface whereby the light can be adjusted to shine on a work area, wherein the trouble light having a tubular handle, the tubular handle having a diameter, the adjustable support device comprising, in combination:

a base member comprised of a cylindrical lower section and a rounded upper section, the cylindrical lower section having a lower end, the lower end having a V-shaped notch extending upwardly thereof, the V-shaped notch having a magnetic surface disposed thereon whereby the V-shaped notch can be secured to a ninety degree ferrous surface, the rounded upper section having a central channel extending downwardly thereof, the rounded upper section having a cross-bar extending laterally therethrough with a center section exposed within the central channel; and a sleeve member pivotally coupled with respect to the base member, the sleeve member including a lower rod and an upper expandable cylindrical sleeve, the lower roc having a lower end having an aperture therethrough, the aperture receiving the center section of the cross-bar of the base member therethrough, the lower rod having an upper end secured to the upper expandable cylindrical sleeve, the expandable upper cylindrical sleeve having a vertical expansion slot extending a length thereof, the expandable upper cylindrical sleeve having a relaxed diameter less than the diameter of the tubular handle of the trouble light, the expandable upper cylindrical sleeve having an open upper end for receiving the tubular handle of the trouble light therein, the expandable upper cylindrical sleeve having a plurality of laterally disposed annular recesses formed therein in a spaced relationship, the annular recesses receiving cable ties for preventing the expansion of the vertical slot.

2. An adjustable support device for a trouble light for allowing a trouble light to be secured to a metal surface whereby the light can be adjusted to shine on a work area, wherein the trouble light having a tubular handle, the tubular handle having a diameter, the adjustable support device comprising, in combination:

a base member comprised of a cylindrical lower section and a rounded upper section, the cylindrical lower section having a lower end, the lower end having a notch extending upwardly thereof, the notch having a magnetic surface disposed thereon whereby the notch can be secured to a ferrous surface, the rounded upper section having a central channel extending downwardly thereof, the rounded upper section having a cross-bar extending laterally therethrough with a center section exposed within the central channel; and a sleeve member pivotally coupled with respect to the base member, the sleeve member including a lower rod and an upper expandable cylindrical sleeve, the lower roc having a lower end having an aperture therethrough, the aperture receiving the center section of the cross-bar of the base member therethrough, the lower rod having an upper end secured to the upper expandable cylindrical sleeve, the expandable upper cylindrical sleeve having a relaxed diameter less than the diameter of the tubular handle of the trouble light, the expandable upper cylindrical sleeve having an open upper end for receiving the tubular handle of the trouble light therein.

3. The adjustable support device for a trouble light as set forth in claim 2, wherein the notch of the base member is V-shaped.

4. The adjustable support device for a trouble light as set forth in claim 2, wherein the expandable upper cylindrical sleeve of the sleeve member has a vertical expansion slot extending a length thereof.

5. The adjustable support device for a trouble light as set forth in claim 4, wherein the expandable upper cylindrical sleeve has a plurality of laterally disposed annular recesses formed therein in a spaced relationship, the annular recesses receiving cable ties for preventing the expansion of the vertical slot.

* * * * *